US009163846B2

(12) United States Patent
Cull et al.

(10) Patent No.: US 9,163,846 B2
(45) Date of Patent: Oct. 20, 2015

(54) VENTILATION APPARATUS ARRANGEMENTS

(75) Inventors: Anthony Francis Cull, Buckinghamshire (GB); Nicholas John Hopper, Buckinghamshire (GB)

(73) Assignee: VKR Holding A/S, Hoersholm (DK)

( * ) Notice: Subject to any disclaimer, the term of this patent is extended or adjusted under 35 U.S.C. 154(b) by 400 days.

(21) Appl. No.: 13/007,717

(22) Filed: Jan. 17, 2011

(65) Prior Publication Data

US 2012/0184198 A1 Jul. 19, 2012

(51) Int. Cl.

| | |
|---|---|
| ***F24F 7/00*** | (2006.01) |
| ***F24F 7/02*** | (2006.01) |
| ***F24F 13/14*** | (2006.01) |
| *F24F 13/12* | (2006.01) |
| *F24F 11/00* | (2006.01) |

(52) U.S. Cl.

CPC ..... *F24F 7/02* (2013.01); *F24F 13/1413* (2013.01); *F24F 13/12* (2013.01); *F24F 2011/0064* (2013.01); *F24F 2221/52* (2013.01)

(58) Field of Classification Search

CPC ..... F24F 13/1426; F24F 13/1413; F24F 2013/10; F24F 2011/002; F24F 7/00; F24F 11/00; F24F 2007/114; F24F 2011/0001; F24F 2011/0064

USPC ..... 454/9, 20, 27, 241, 242, 250, 277, 358, 454/364, 367

See application file for complete search history.

(56) References Cited

U.S. PATENT DOCUMENTS

| | | | | | |
|---|---|---|---|---|---|
| 36,059 | A | * | 7/1862 | Muir | 454/241 |
| 45,814 | A | * | 1/1865 | Burnett | 454/242 |
| 187,433 | A | * | 2/1877 | Unkrich | 454/8 |
| 297,707 | A | * | 4/1884 | Muller | 454/9 |
| 693,193 | A | * | 2/1902 | Waldmire | 454/199 |
| 778,204 | A | * | 12/1904 | Porter | 454/136 |
| 902,509 | A | * | 10/1908 | Speer | 454/358 |
| 1,086,160 | A | * | 2/1914 | Graef | 454/358 |
| 1,289,821 | A | * | 12/1918 | Laakso | 454/242 |
| 1,672,291 | A | * | 6/1928 | Williams | 454/20 |
| 2,203,444 | A | * | 6/1940 | Schilling | 454/363 |
| 2,263,846 | A | * | 11/1941 | Herman et al. | 454/357 |
| 2,266,261 | A | * | 12/1941 | Pfeifer, Jr. | 454/362 |
| 2,356,325 | A | * | 8/1944 | Larsen | 454/277 |
| 2,856,835 | A | * | 10/1958 | Horne | 454/364 |
| 3,073,525 | A | * | 1/1963 | Cislo | 236/49.5 |
| 3,715,967 | A | * | 2/1973 | Field | 454/357 |

(Continued)

FOREIGN PATENT DOCUMENTS

| | | |
|---|---|---|
| DE | 2 000 254 | 1/1970 |
| GB | 2 445 800 A | 7/2008 |

(Continued)

*Primary Examiner* — Steven B McAllister
*Assistant Examiner* — Frances F Hamilton
(74) *Attorney, Agent, or Firm* — Harrington & Smith

(57) ABSTRACT

A ventilation apparatus arrangement 10 for ventilating the interior 12 of a building. The ventilation arrangement 10 includes a duct 18 extending to above the roof 14 of the building. The duct 18 is square in cross section and is divided into four quadrants by internal vertical divider plates. A louvre arrangement 22 is provided on each side of the upper part of the duct 18 to receive air into the building on a windward side of the duct 18, and to expel air from a leeward side of the duct 18. A closure arrangement 26 is provided for selectively partially or wholly closing the louvre arrangements 22, for instance in the event of bad weather.

18 Claims, 4 Drawing Sheets

(56) References Cited

U.S. PATENT DOCUMENTS

| | | | | | |
|---|---|---|---|---|---|
| 3,822,637 | A | * | 7/1974 | Whitlock | 454/20 |
| 4,043,256 | A | * | 8/1977 | Van Huis | 454/238 |
| 4,649,808 | A | * | 3/1987 | Ward et al. | 454/17 |
| 4,744,409 | A | * | 5/1988 | Berner | 165/4 |
| 5,653,632 | A | * | 8/1997 | Ogawa et al. | 454/343 |
| 5,934,993 | A | * | 8/1999 | Maruyama | 454/250 |
| 7,036,960 | B1 | * | 5/2006 | Gretz | 362/354 |
| 7,101,279 | B2 | * | 9/2006 | O'Hagin et al. | 454/364 |
| 7,152,419 | B1 | * | 12/2006 | Armour et al. | 62/187 |
| 2010/0056038 | A1 | * | 3/2010 | Ramsay et al. | 454/364 |
| 2011/0201264 | A1 | * | 8/2011 | Hendrickson | 454/253 |
| 2011/0223848 | A1 | * | 9/2011 | Lipinski | 454/1 |

FOREIGN PATENT DOCUMENTS

| | | | | | |
|---|---|---|---|---|---|
| JP | 57188022 | A | | 11/1982 | |
| JP | 61116231 | A | * | 6/1986 | F24F 7/04 |
| JP | 62162530 | A | | 7/1987 | |
| JP | 2000110453 | A | | 4/2000 | |
| JP | 2000171083 | A | * | 6/2000 | F24F 11/02 |
| JP | 2002118019 | A | | 4/2002 | |
| JP | 2007026631 | A | | 2/2007 | |
| WO | WO-2012/080736 | A1 | | 6/2012 | |

* cited by examiner

VENTILATION APPARATUS ARRANGEMENTS

The present invention relates to a ventilation arrangement for ventilating a building interior.

The provision of adequate ventilation is an important consideration in building design. The combination of heat gains generated within buildings by occupants and electrical equipment and solar heat gain can cause a significant build up of heat and, therefore overheating.

Air conditioning or other mechanical ventilation systems can be used to provide ventilation to buildings to address these difficulties. However, such systems consume electricity and can, therefore, be relatively expensive to operate.

One prior arrangement is to provide a duct extending from just above roof level into a building, with the upper end of the duct connecting to outwardly facing openings extending around the duct. During use air can enter the windward side of the duct through respective openings, with stale air exiting from the building through respective openings on the leeward side of the duct.

In such a configuration, the duct is divided by radial dividers, which could for instance divide the ducting into four quadrants, with the quadrant nearest the windward side receiving the most air to ventilate the building, whilst the majority of air extracted from the building exits through the opposite quadrant on the leeward side of the arrangement.

Such arrangements have operated successfully in providing ventilation with little or no power input. However, problems can be encountered in extreme weather with such arrangements, for example with very heavy rain and particularly snow, leading to ingress of precipitation into the apparatus.

According to the present invention there is provided a ventilation arrangement comprising:

an air duct which extends in use from roof level into an interior of the building to be ventilated to convey air between the exterior and interior of the building, the air duct being polygonal in plan view and being divided into a plurality of duct sections by divider plates extending between upper and lower ends of the ventilation arrangement, and being arranged to direct moving air caused by wind movement through one or more of the duct sections on a windward side of the air duct into the building interior, and to exhaust air from the interior of the building through one or more other of the duct sections on a leeward side of the air duct;

ventilation openings for each side of the polygon which extend around an upper part of the air duct to direct moving air caused by wind movement into or out of the air duct; the ventilation openings comprising an outer louvre arrangement defining a plurality of discrete openings, one above each other, and a closure arrangement comprising an inner louvre arrangement, the inner and outer louvre arrangements being selectively slidable relative to each other between a closed condition closing the ventilation openings, and an open condition substantially clear of the ventilation openings, the closure arrangement including a plurality of closure members, each selectively movable between a closed position substantially closing a respective discrete opening, and an open position leaving the respective discrete opening substantially open.

The closure arrangement may be configured to permit partial closure of the ventilation openings.

The closure members may be connected to an actuator member such that the closure members are all simultaneously movable between the open and closed conditions.

The closure arrangement may be manually operable and/or operable by an electric motor, or actuator.

The closure arrangement may be operable from the building interior, and a control member may extend from the actuator member into the building.

Automatic control means may be provided for automatically moving the closure arrangement between the open and closed conditions as required. The automatic control means may be connected to a weather station or detectors so as to automatically move the closure arrangement to or towards a closed position when bad weather is forecast or detected.

The automatic control means may be connected to a timer so as to automatically move the closure arrangement between open and closed conditions for particular times or seasons of the year.

An embodiment of the present invention will now be described by way of example only and with reference to the accompanying drawings, in which.

Figure 1:
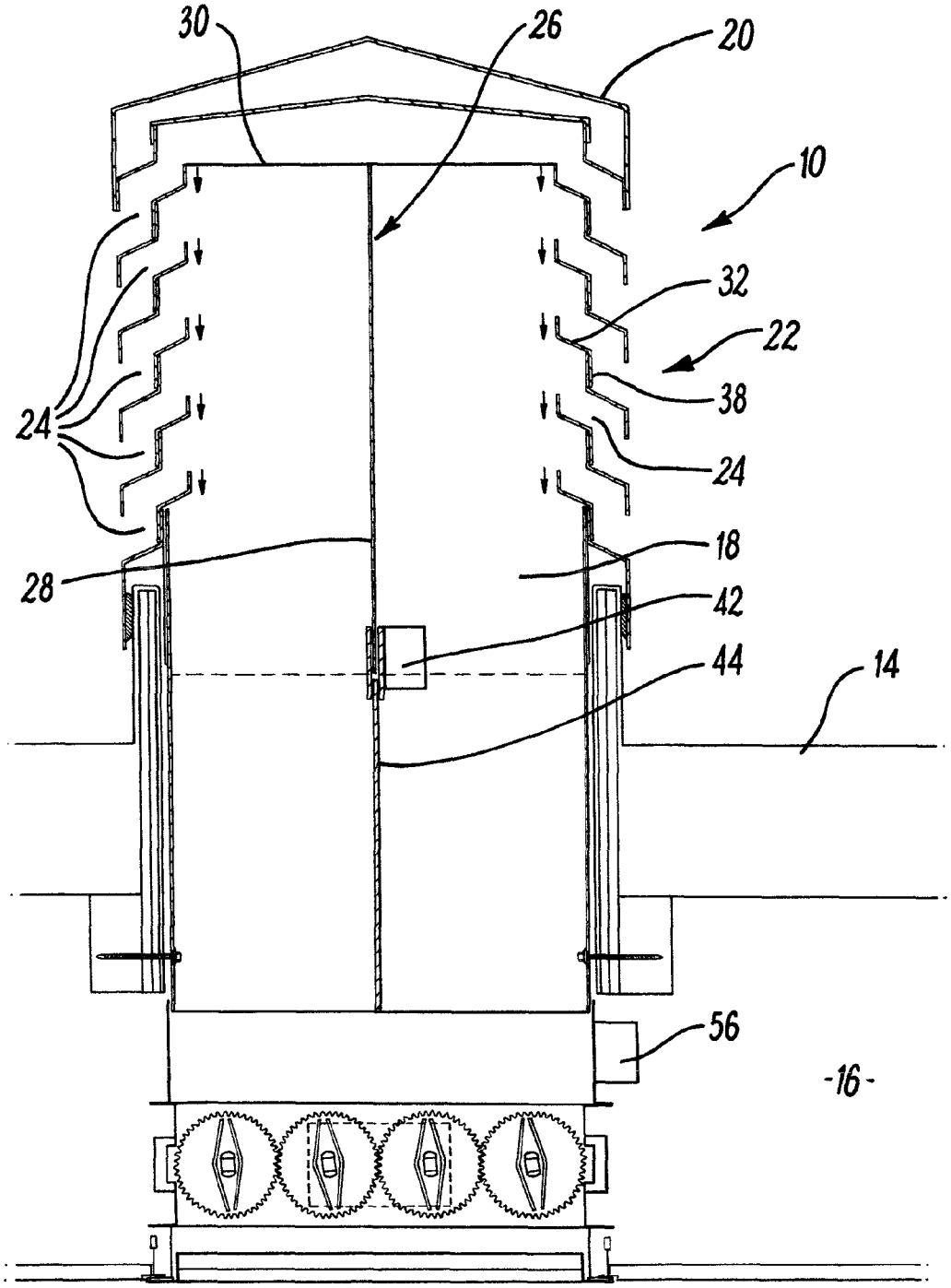
FIG. 1 is a diagrammatic cross sectional side view of a first ventilation arrangement according to the invention in an open condition.

FIGS. 1 to 4 of the drawings show a first ventilation arrangement 10 according to the invention for ventilating an interior 12 of a building. The ventilation arrangement 10 is mounted on a roof 14 of a building and extends through the roof space 16 to the building interior 12.

The arrangement 10 comprises a duct 18 which extends vertically to above the roof 14. The duct 18 is divided into four quadrants by vertical divider plates (not shown). These plates divide the duct such that air on the windward quadrants will enter the arrangement 10, whilst air on the leeward side will exit from the interior 12 through the arrangement 10. In this arrangement 10 the duct 18 is of square cross section, but other cross sectional shapes such as circular could be used.

The top end of the duct 18 is closed by a turret 20. Beneath the turret 20 a louvre arrangement 22 is provided which defines five downwardly and outwardly extending openings 24 extending from the interior of the duct 18 to atmosphere.

A closure arrangement 26 is provided which comprises a central bar 28 extending upwardly through the duct 18 to an upper plate 30. The bar 28 may house the divider plates. Extending downwardly on each side from the plate 30 is an inner louvre arrangement 32. The inner louvre arrangement 32 is of a similar configuration to the outer louvre arrangement 22 but is set inwardly and comprises a first downwardly extending section 34 from which an outwardly and downwardly inclined second section 36 extends to a downwardly extending third outer section 38.

Figure 2:
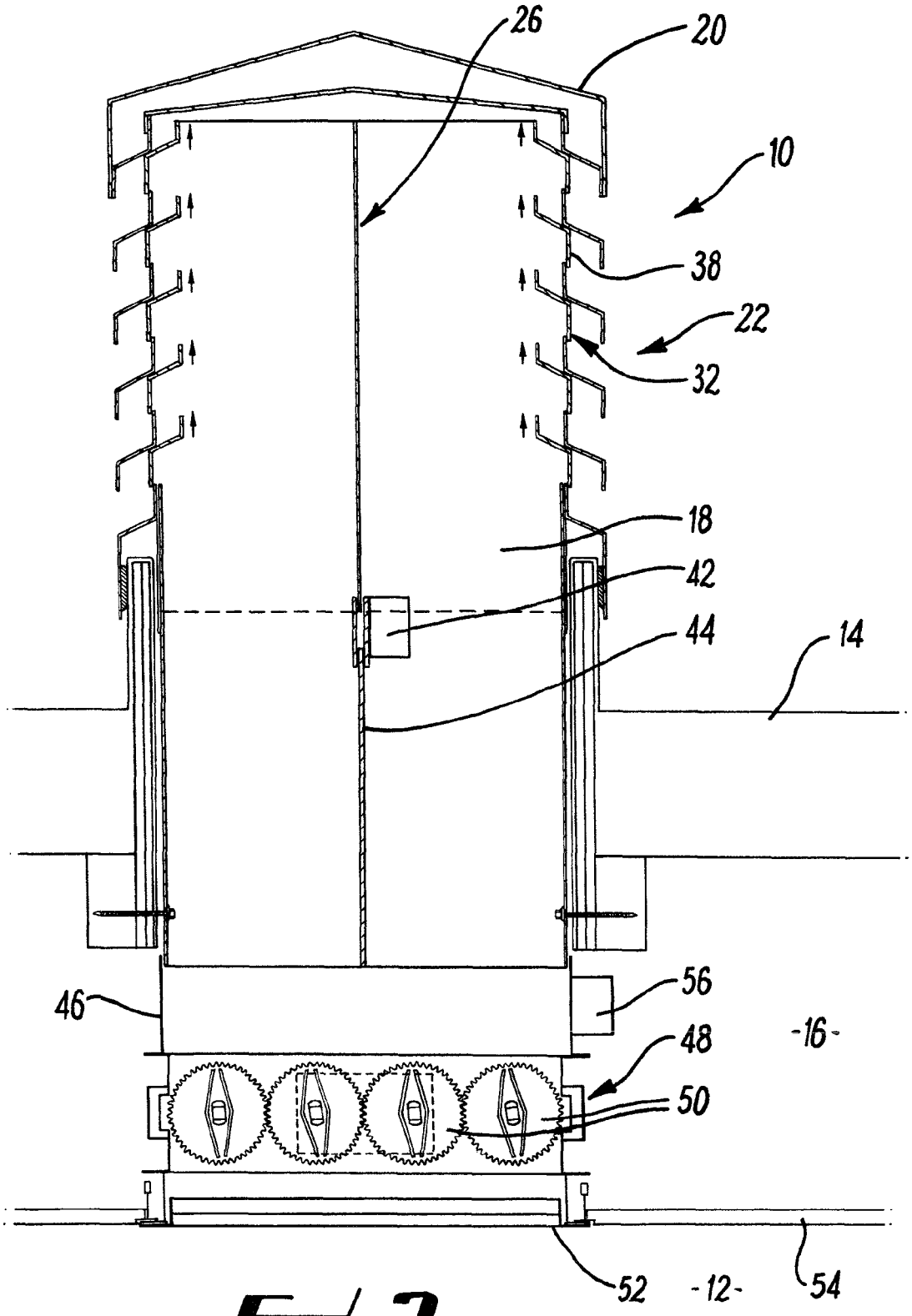
FIG. 2 is a similar view to FIG. 1 but in a closed condition.
Figure 3:
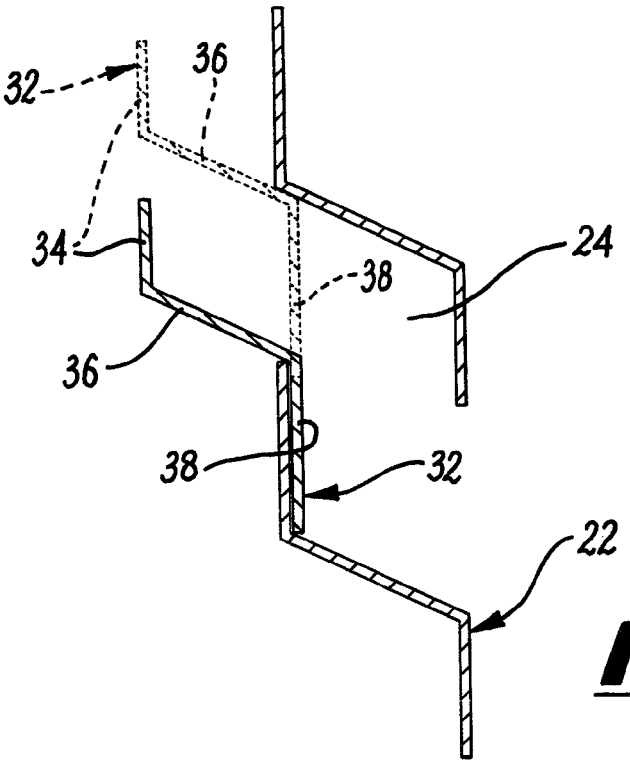
FIG. 3 is a diagrammatic detailed cross sectional view showing part of the arrangement of FIG. 1 in fully open and closed conditions.
Figure 4:
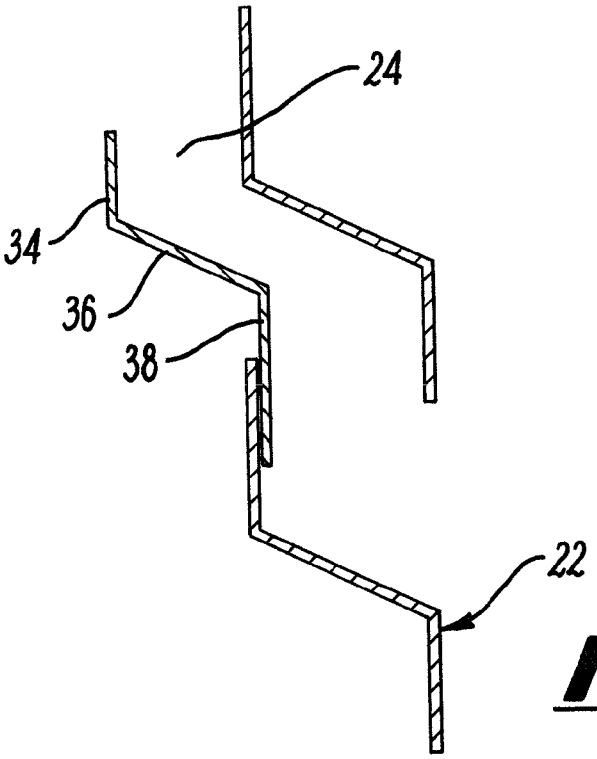
FIG. 4 is a similar view to FIG. 3 but showing the arrangement in a partially open condition.

In a raised condition of the closure arrangement 26 as shown in FIG. 2 and in broken lines in FIG. 3, each third outer section 38 closes a respective one of the openings 24. In a lower open position as shown in FIG. 1, the third outer section 38 is clear of the respective openings 24, and lies parallel to the inner first section 44 of the louvre arrangement 22. FIG. 4 shows a partially open configuration, with the third outer sections 38 partially closing the respective openings 24.

The bar 28 extends within the duct 18 to a little below the outer louvre arrangement 22 and connects to an actuator 42 mounted on a further bar 44 which extends downwardly to a lower part of the duct 18. The actuator 42 can be mechanically operable by a connection to the further bar 44 extending into the building interior 12. In addition, the actuator 42 can be controlled by an electrical motor (not shown). A guide wheel or a geared rack can be used to provide vertical movement of the central bar 28.

Ductwork 46 extends beneath the duct 18 and leads to an airflow control arrangement 48 with dampers 50 for controlling the flow of air between the exterior and interior 12 of the building. Beneath the air flow arrangement 48 a grille 52 is provided in the ceiling 54.

A programmable automatic control box 56 is provided for automatic actuation of the closure arrangement 26. The control box 56 can be programmed by season allowing for instance a 25% opening in winter mode when lower external temperatures provide a greater driving force for natural ventilation. During spring and autumn modes the closure arrangement could be programmed to be 50% open, and during summer mode to provide maximum ventilation, the closure arrangement can be set to 100% open.

The control box 56 could also be linked to a weather station, which could be locally mounted. This could provide a control signal prior to or during very poor weather conditions. These conditions could be strong winds, heavy rain, snow or very low external temperatures. This can particularly prevent for instance snow being carried into the arrangement 10.

There is thus described a ventilation arrangement with additional control features. The amount of possible ventilation can be varied for different seasons and also particularly when bad weather is expected or occurring. The arrangement is however of mechanically straightforward configuration and can thus be inexpensively constructed for long term essentially maintenance free operation.

Figure 5:
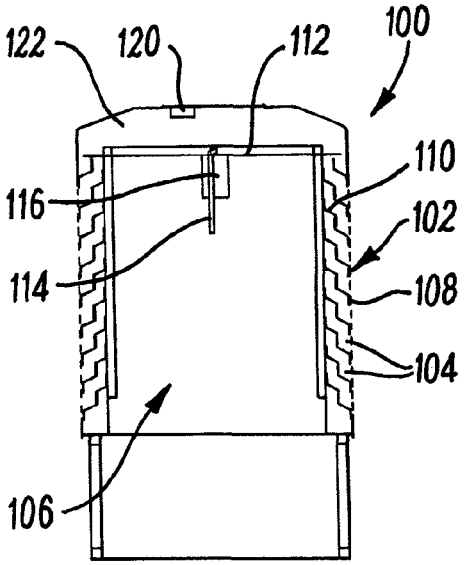
FIG. 5 is a diagrammatic cross sectional side view of a second ventilation arrangement according to the invention in an open condition.
Figure 6:
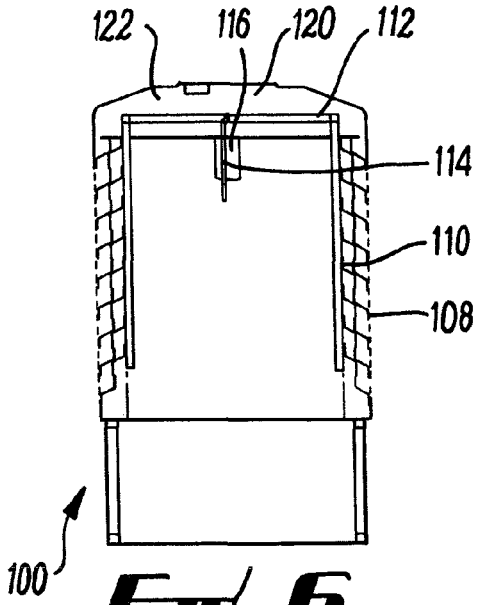
FIG. 6 is a similar view to FIG. 5 but in a closed condition.
Figure 7:
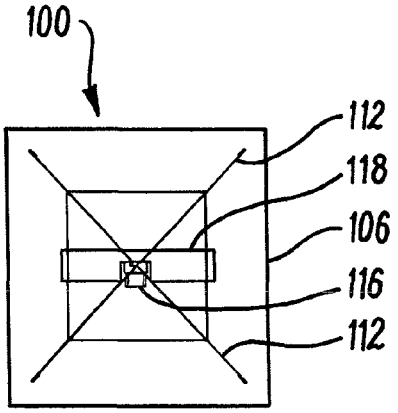
FIG. 7 is a diagrammatic plan view of the arrangement of FIG. 5.

FIGS. 5 to 7 of the drawings show a second ventilation arrangement 100 according to the invention which is similar in many respects to the arrangement 10, and only the differences will be described. In this instance a louvre arrangement 102 is provided which defines eight openings 104 on each side of the duct 106. The louvre arrangement 102 again comprises a fixed outer louvre arrangement 108 and a movable inner louvre arrangement 110.

The upper ends of the inner louvre arrangement 110 on each side are attached adjacent the corner of the square duct 106, to an end of the respective arm of a horizontally extending cruciform support 112. A downwardly extending bar 114 is provided at the centre of the support 112, and the bar 114 is operatively engageable with a linear actuator 116, for raising and lowering the support 112. The linear actuator 116 is mounted on a support plate 118 which extends across part of the top of the duct 106.

A solar panel 120 is provided on the top end of a turret 122 which closes the top end of the duct 106. The solar panel 120 may power the actuator 116, and any control or sensor equipment for the arrangement 100.

By vertical movement of the bar 114 by operation of the actuator 116, any required position of the inner louvre arrangement 110 can be chosen between the fully closed position shown in FIG. 6 and the fully open position shown in FIG. 5, to vary the amount of ventilation into and out of the duct 106.

Various other modifications may be made without departing from the scope of the invention. For instance, whilst some automatic operation has been described, other automatic operation could be possible for instance dependent on temperature or other conditions. Also controls could be provided for manual override of the automatic controls by a user of the building. Whilst a double louvre arrangement has been described, other ways could be provided of providing selective opening or closing of the openings. Also the openings may take a different form.

As indicated the duct may be other than of square cross section, and could be a different polygonal shape, or circular or oval. A different number of openings could be provided by the louvre arrangement. The actuator could be provided at a different location, such as under the turret or any other capping provided for the arrangement.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A ventilation apparatus arrangement comprising:

an air duct which extends in use from roof level into an interior of a building to be ventilated to convey air between the exterior and interior of the building, the air duct being polygonal in plan view and being divided into a plurality of duct sections by divider plates extending between upper and lower ends of the ventilation arrangement such that the air duct directs air motion caused by wind movement through one or more of the duct sections on a windward side of the air duct into the building interior, and to exhaust air from the interior of the building through one or more other of the duct sections on a leeward side of the air duct;

ventilation openings for each side of the polygon which extend around an upper part of the air duct directing air motion caused by wind movement into or out of the air duct;

the ventilation openings comprising an outer louvre arrangement defining a plurality of discrete openings, one above each other, and a closure arrangement comprising an inner louvre arrangement, the inner louvre arrangement being selectively slidable relative to the outer louvre arrangement between a closed condition closing the ventilation openings, and an open condition substantially clear of the ventilation openings, the inner louvre arrangement including a plurality of closure members, each movable between a closed position substantially closing a respective discrete opening, and an open position leaving the respective discrete opening substantially open, the closure members being connected to an actuator member such that the closure members on each side of the polygon are all simultaneously movable between the open and closed conditions, the closure arrangement being configured to permit partial closure of the ventilation openings with the closure members being held in positions between the open and closed conditions, wherein each of the closure members comprises a first portion, a second portion, and a third portion, wherein the first, second, and third portions are angled relative to each other, and wherein the outer louvre arrangement comprises a plurality of louvre members having a first portion, a second portion, and a third portion, wherein the first, second, and third portions are angled relative to each other.

2. An arrangement according to claim 1, in which the closure arrangement is manually operable.

3. An arrangement according to claim 1, in which the closure arrangement is operable by an electric motor or actuator.

4. An arrangement according to claim 1, in which the closure arrangement is operable from the building interior.

5. An arrangement according to claim 4, in which a control member extends from the actuator member into the building.

6. An arrangement according to claim 1, in which automatic control means is provided for automatically moving the closure arrangement between the open and closed conditions as required.

7. An arrangement according to claim 6, in which the automatic control means is connected to a weather station or detectors so as to automatically move the closure arrangement in response to the weather forecast or detected.

8. An arrangement according to claim 6, in which the automatic control means is connected to a timer so as to automatically move the closure arrangement between open and closed conditions for particular times or seasons of the year.

9. An arrangement according to claim 1 in which the inner louvre arrangement on each side of the polygon is attached to a horizontally extending support.

10. An arrangement according to claim 9 in which a downwardly extending bar is provided on the support, and the bar is operatively engageable with the actuator member, for raising and lowering the support.

11. An arrangement according to claim 10 in which the downwardly extending bar is provided at the centre of the support.

12. An arrangement according to claim 9 in which the support is a horizontally extending cruciform support, and the inner louvre arrangement on each side of the polygon is attached to an end of a respective arm of the horizontally extending cruciform support.

13. An arrangement according to claim 1 in which the actuator member is mounted on a support plate which extends across part of the top of the air duct.

14. An arrangement according to claim 1, wherein the ventilation openings are closed when the inner louvre arrangement is raised relative to the roof level.

15. An arrangement according to claim 14, wherein a top portion of the arrangement is configured to remain stationary relative to the roof level between the open condition and the closed condition.

16. An arrangement according to claim 14, wherein the outer louvre arrangement is configured to remain stationary relative to the roof level between the open condition and the closed condition.

17. A ventilation apparatus arrangement comprising:

an air duct which extends in use from roof level into an interior of a building to be ventilated to convey air between the exterior and interior of the building, the air duct being polygonal in plan view and being divided into a plurality of duct sections by divider plates extending between upper and lower ends of the ventilation arrangement such that the air duct directs air motion caused by wind movement through one or more of the duct sections on a windward side of the air duct into the building interior, and to exhaust air from the interior of the building through one or more other of the duct sections on a leeward side of the air duct;

ventilation openings for each side of the polygon which extend around an upper part of the air duct directing air motion caused by wind movement into or out of the air duct;

the ventilation openings comprising an outer louvre arrangement defining a plurality of discrete openings, one above each other, and a closure arrangement comprising an inner louvre arrangement, the inner louvre arrangements being selectively slidable relative to the outer louvre arrangement between a closed condition closing the ventilation openings, and an open condition substantially clear of the ventilation openings, the inner louvre arrangement including a plurality of closure members, each movable between a closed position substantially closing a respective discrete opening, and an open position leaving the respective discrete opening substantially open, wherein the closure members on each side of the polygon are all configured to be simultaneously movable between the open and closed conditions, the closure arrangement being configured to permit partial closure of the ventilation openings with the closure members being held in positions between the open and closed conditions, wherein each of the closure members comprises a first portion, a second portion, and a third portion, wherein the first, second, and third portions are angled relative to each other, and wherein the outer louvre arrangement comprises a plurality of louvre members having a first portion, a second portion, and a third portion, wherein the first, second, and third portions are angled relative to each other.

18. An arrangement according to claim 17, wherein the ventilation openings are closed when the inner louvre is raised relative to the roof level, and wherein the outer louvre arrangement is configured to remain stationary relative to the roof level between the open condition and the closed condition.

* * * * *